US005280855A

United States Patent [19]

Rietsch, Jr.

[11] Patent Number: 5,280,855

[45] Date of Patent: Jan. 25, 1994

[54] MODULAR HIGH PRESSURE SPRAY SYSTEM FOR VEHICLE WASHING APPARATUS AND METHOD OF CONSTRUCTION

[76] Inventor: Gilbert J. Rietsch, Jr., 5825 Paint Valley, Rochester, Mich. 48306

[21] Appl. No.: 737,171

[22] Filed: Jul. 29, 1991

[51] Int. Cl.[5] ..... B05B 3/14

[52] U.S. Cl. ..... 239/264; 239/556; 239/225.1; 134/123

[58] Field of Search ..... 134/123; 239/225.1, 239/264, 242, 263, 237, 550, 556

[56] References Cited

U.S. PATENT DOCUMENTS

| | | | |
|---|---|---|---|
| 2,896,644 | 7/1959 | Emanuel | 134/123 |
| 2,936,770 | 5/1960 | Emanuel | 134/123 |
| 3,190,297 | 6/1965 | Austin et al. | 134/123 |
| 3,259,138 | 7/1966 | Heinicke | 134/123 |
| 3,261,369 | 7/1966 | Thiele | 134/123 |
| 3,650,281 | 3/1972 | Hurst | 134/123 |
| 4,716,916 | 1/1988 | Hodge | 134/123 |
| 4,857,113 | 8/1989 | Hodge | 134/123 |
| 4,972,862 | 11/1990 | Belanger et al. | 134/123 |

FOREIGN PATENT DOCUMENTS

| | | | |
|---|---|---|---|
| 509564 | 7/1939 | United Kingdom | 134/123 |

*Primary Examiner*—David M. Mitchell
*Assistant Examiner*—Christopher G. Trainor
*Attorney, Agent, or Firm*—John R. Benefiel

[57] ABSTRACT

A spray nozzle system for vehicle washing apparatus is disclosed featuring a modular construction in which nearly identical base oscillating nozzle spray units are used for the sides, top, and front and rear nozzle sets. Each spray unit includes a bracket module and attached motor-drive module, and an additional bracket module can be connected end to end to create a doubling of nozzle sets in the unit. The bracket module rotatably supports a nozzle set mounting spray nozzle manifold shaft of either single or double length, supplied by a rotary fluid coupling clamped in a bracket included in each bracket module. The spray nozzle module shaft is oscillated by the motor drive module.

7 Claims, 5 Drawing Sheets

MODULAR HIGH PRESSURE SPRAY SYSTEM FOR VEHICLE WASHING APPARATUS AND METHOD OF CONSTRUCTION

This invention concerns vehicle Washing apparatus, i.e., car washes, of the type using high pressure spray jets to clean the exterior of the vehicle. Recent trends have been to reduce the use of brushes and scrubbers to minimize abrasion of the vehicle finish, and rely instead on chemical pretreatment and high pressure sprays.

These sprays currently involve arrays of spray nozzles distributed about the vehicle sides and top, as well as in the path of the vehicle directing sprays at the front and rear of the vehicle as it is moved along by the conveyor system. Typically, the nozzles are arrayed in a variety of manifold and piping configurations for each location.

Narrow angle orifice nozzles are often used, oscillated at high rates to provide effective coverage of the portion of the vehicle surface to be cleaned.

The variety of configurations of the manifolds and piping increase the cost of manufacture of the equipment apparatus, and also make it difficult to integrate existing equipment with later installed items. Furthermore, it is difficult to inventory parts for replacement due to the great number of different parts, thus reducing the ready availability of particular items.

SUMMARY OF THE INVENTION

The present invention comprises a modular high pressure spray system for car washes in which a common module is employed for all locations about the vehicle. A limited number of common components may be assembled in varying configurations to provide flexibility in the particular application.

The base module includes a bracket base plate which can fixedly mount an oscillation motor housing and rotationally support a spray nozzle manifold shaft extending with its longitudinal axis parallel beneath the motor on a series of bracket plates fixed to the base plate. An end bracket plate is configured to clamp a swivel fitting for attachment of a water line to the spray nozzle shaft while accommodating oscillation of the shaft by a crank rotated by the oscillation motor and a link pinned to an arm clamped to the spray nozzle manifold shaft adjacent to one of the brackets. Nozzle "trees" are mounted in each of a pair of nozzle ports in the spray nozzle manifold shaft.

The base module may be oriented vertically for the front and rear cleaning installations, clamped to a bracket fixture installed on the edge of the car wash pit. The same base module is also installed horizontally alongside or over the vehicle, clamped to the side or top members of an arch so that the nozzle trees extend horizontally.

An array of fixed piping may also be installed on the arch to supply the oscillation motors and spray nozzle shafts.

An additional identical bracket base plate may be later assembled aligned end to end, with the first and second base plates bolted onto a connector plate, the second base plate brackets thereof rotationally supporting the out base end of a double length spray nozzle shaft able to supply four spray nozzle arrays, in order that oppositely inclined spray nozzles may be incorporated in the base module.

Thus, a limited number of common components may be used for all of the spray nozzle arrays, which components are combinable to form varying configuration spray nozzle units. The systems so formed can be readily added onto or modified at relatively low cost. The limited number of common components allow ready availability for replacement or addition.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
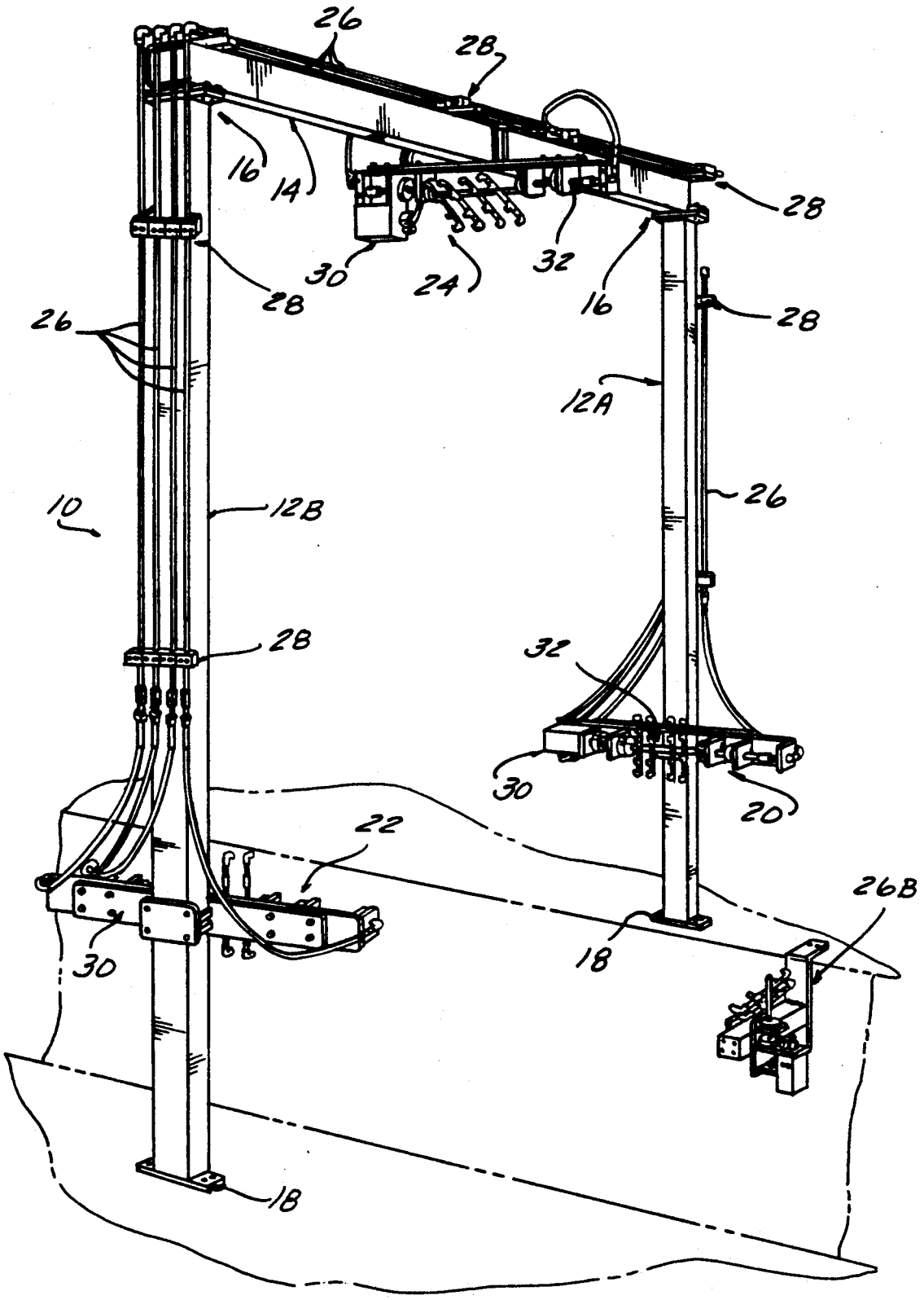
FIG. 1 is a perspective view of a high pressure spray system according to the present invention.

Referring to the drawings and particularly FIG. 1, an arch 10 is shown, which may be of conventional construction, i.e., sections of 4 inch square tubing 12, 14 of stainless steel, bolted together in vertical and horizontal sections by means of flanges 16 and mounted to the floor with flanges 18.

The spray system illustrated includes passenger side double spray unit 20 clamped to one vertical arch section 12A, a horizontal driver side double spray unit 22 clamped to the other vertical arch section 12B, a horizontal top double spray unit 24 clamped to the overhead arch section 14, and vertical front and rear base spray units 26A, 26B installed in the trough.

A fixed network of tubing sections 26 is fixed to the outside of each arch section 12, 14 to supply hydraulic fluid to the oscillation motors of each spray unit, including two sets of four tubes 26, each leading from the upper right hand corner of the arch, supported on clamping blocks 28 secured to the arch sections 12, 14. Four tubing sections 26 run to a point adjacent each spray unit 20, 22, 24 where flexible hose connections are made to oscillation motors 30 and to opposite ends of each spray nozzle manifold shafts 32 included in each double spray unit 20, 22, 24. Connections to external sources (not shown) are made at the upper right hand corner.

Figure 2:
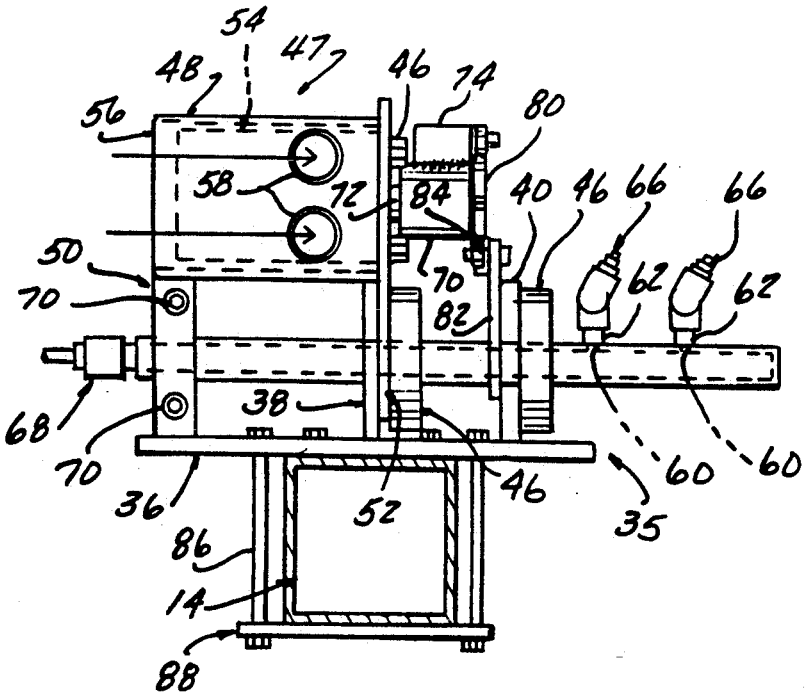
FIG. 2 is a side elevational view of a base module incorporated as a top spray unit to the present invention.

FIG. 2 illustrates a base spray unit 34 incorporated in each of the double spray units 20, 22, 24, and comprising the spray units 26A, 26B, which includes a bracket base module 35 including a bracket plate 36 having a pair of parallel, spaced rotary bearing brackets 38, 40 fixed thereto as by welding.

Each bracket 38, 40 has a nozzle manifold shaft clearance bore 42 formed therein, here shown as receiving a short length spray nozzle manifold shaft 44. An annular plastic bearing 46 is affixed to opposing inside faces of the brackets 38, 40 slidably fit to the shaft 44 so as to provide a spaced rotary support therefore. Such bearings are well known, constructed of very high molecular weight (HMW) plastic, attached with four screws received in threaded holes in each bracket 38, 40.

A motor module 47 is mounted to the bracket module 35, the motor module 47 including an oscillation motor housing 48 extending over bracket 38 and a split clamping bracket 50 at one end of the bracket plate 36. The motor housing 48 is mounted by a flange plate 52 extending beneath bearing 46 and attached to intermediate bracket 38. A hydraulic oscillation motor 54 is received in the open end 56 of the housing 48 and fastened against the inside face of the flange plate 52. A pair of access ports 58 allow connection of hydraulic lines to the hydraulic motor 54.

The spray nozzle manifold shaft 44 has a longitudinal axis and is mounted with its axis in parallel alignment with the motor 54, disposed spaced therebelow has an internal passage drilled therein communicating with a pair of threaded outlets 60 receiving nipples 62. The nipples 62 in turn have nozzle "trees" connected thereto, comprised of a series of plumbing fittings, each tree 64 mounting and supplying a set of spray nozzles 66 inclined at an angle towards the approaching vehicle. A rotary coupling 68 is clamped in the split bracket 50, secured with screws 70, which enables a flexible hose connection to supply wash solution to the spray nozzles 66.

The spray nozzle manifold shaft 44 is oscillated by the motor 54 by means of a crank and linkage system 68, including an annular crank 70 secured to the output shaft 72 of the motor 54 extending parallel to the longitudinal axis of the spray nozzle shaft 44. The crank 70 has a projection 74 affixed thereto having an axial connection hole 76 drilled therethrough, spaced radially outward from a second connection hole 78 drilled axially through the wall of the crank 70. This provides alternate connection points for one end of a line 80, each point eccentrically located to varying degrees with respect to the axis of rotation of the motor shaft 72 to create a varying extent of oscillations of the spray nozzle manifold shaft 44. This oscillation is caused by connection of the other end of the link 80 to an arm 82 clamped by means of split sleeve 84 to the shaft 44. The clamping attachment allows adjustment of the position of the shaft 44 relative the angular position of the motor shaft 72 to properly orient the nozzles 66.

The nozzles 66 may be set to provide a relatively narrow jet, since the shaft 44 is oscillated to provide coverage. Preferably the nozzles 55 on the spray unit on the side remote from the conveyor are set at 5 degrees to produce tighter jets than the nozzles 66 on the spray unit on the conveyor side, i.e., 15 degrees for example, since the distance between the vehicle surface and the nozzle 66 varies much less. The nozzles 66 should also be tight on the overhead units, i.e., 5 degrees to allow for varying size vehicles.

An oscillation rate on the order of 100 cycles per minute has been found to provide adequate coverage.

The base unit 34 is clamped to an arch section 12A, 12B or 14 by means of a series of bolts 86 passing through holes in the plate 36 and holes in a clamping plate 88 positioned on the far side of the arch section.

Figure 2A:
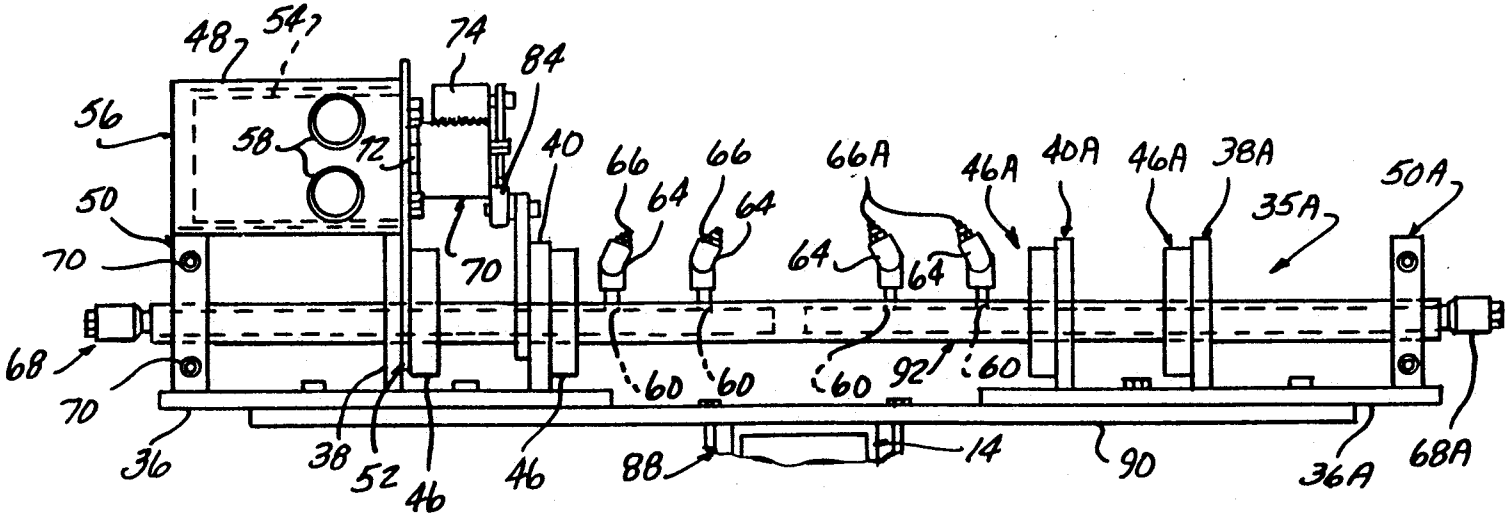
FIG. 2A is a side elevational view of a base module with the auxiliary bracket plate and reverse nozzle manifold. shaft installed thereon.
Figure 5:
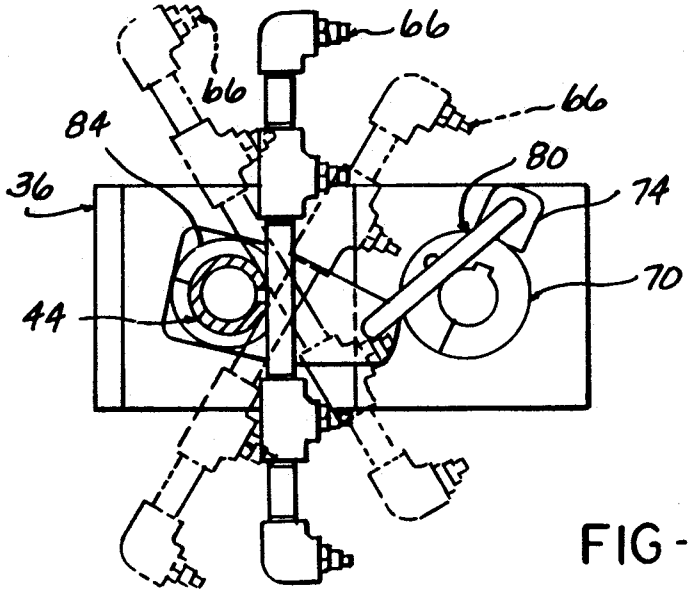
FIG. 5 is an end view of the oscillation motor, associated linkage and nozzle tree illustrating the oscillation induced by the oscillation motor.

The base unit 34 is readily converted to another double nozzle set configuration, having four sets of nozzles 66, as shown in FIG. 2A, in which a second bracket module 35A comprised of a bracket base plate 36A is mounted on a connector plate 92, also fixed to the first bracket base plate 38 by bolts to position the first and second bracket base plates 36, 36A aligned end to end but spaced apart. The hole pattern used to directly clamp the bracket base plate 36 to an arch section is advantageously used to secure to the connector plate 90. The second bracket module 35A is identical to the base module 34.

Spaced brackets 38A, 40A, and clamping bracket 50A are welded to the bracket base plate 36A, with annular bearings 46A affixed to one side of each bracket 38A, 40A.

A double length spray nozzle manifold shaft 92 is here used, extending the complete length of the assembly of the first and second bracket modules 35, 35A. A second rotary coupling is secured in clamping bracket 50A. The interior of the double length shaft is formed with oppositely extending internal passages which terminate short of each other to provide independent supply circuits for nozzle trees 64, 64A. The second set of nozzles 66A would normally be oppositely angled from the nozzles 66 of the first set to obtain enhanced coverage by the washing jets.

The connector plate 90 is used to clamp the entire assemblage to the arch section with bolts received in a central hole pattern of the connector plate 90.

Figure 3:
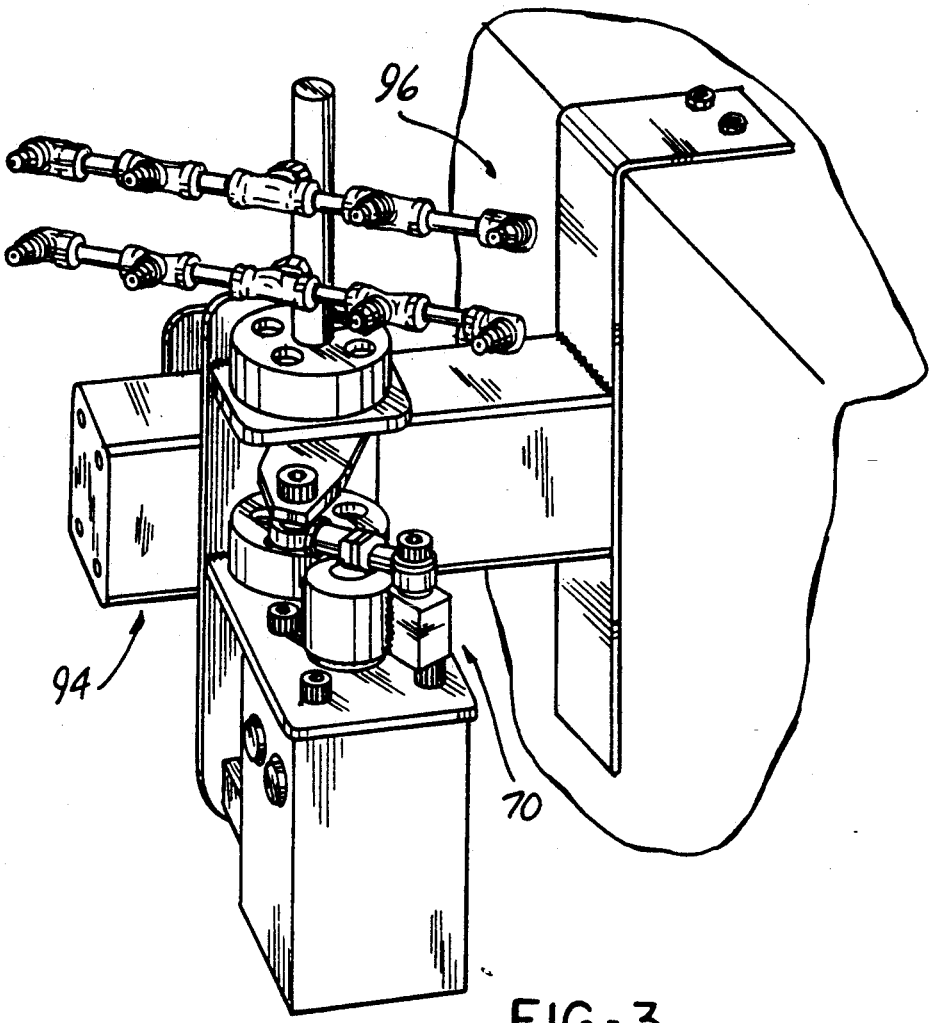
FIG. 3 is a perspective view of a base module installed as a front or rear spray nozzle unit.
Figure 4:
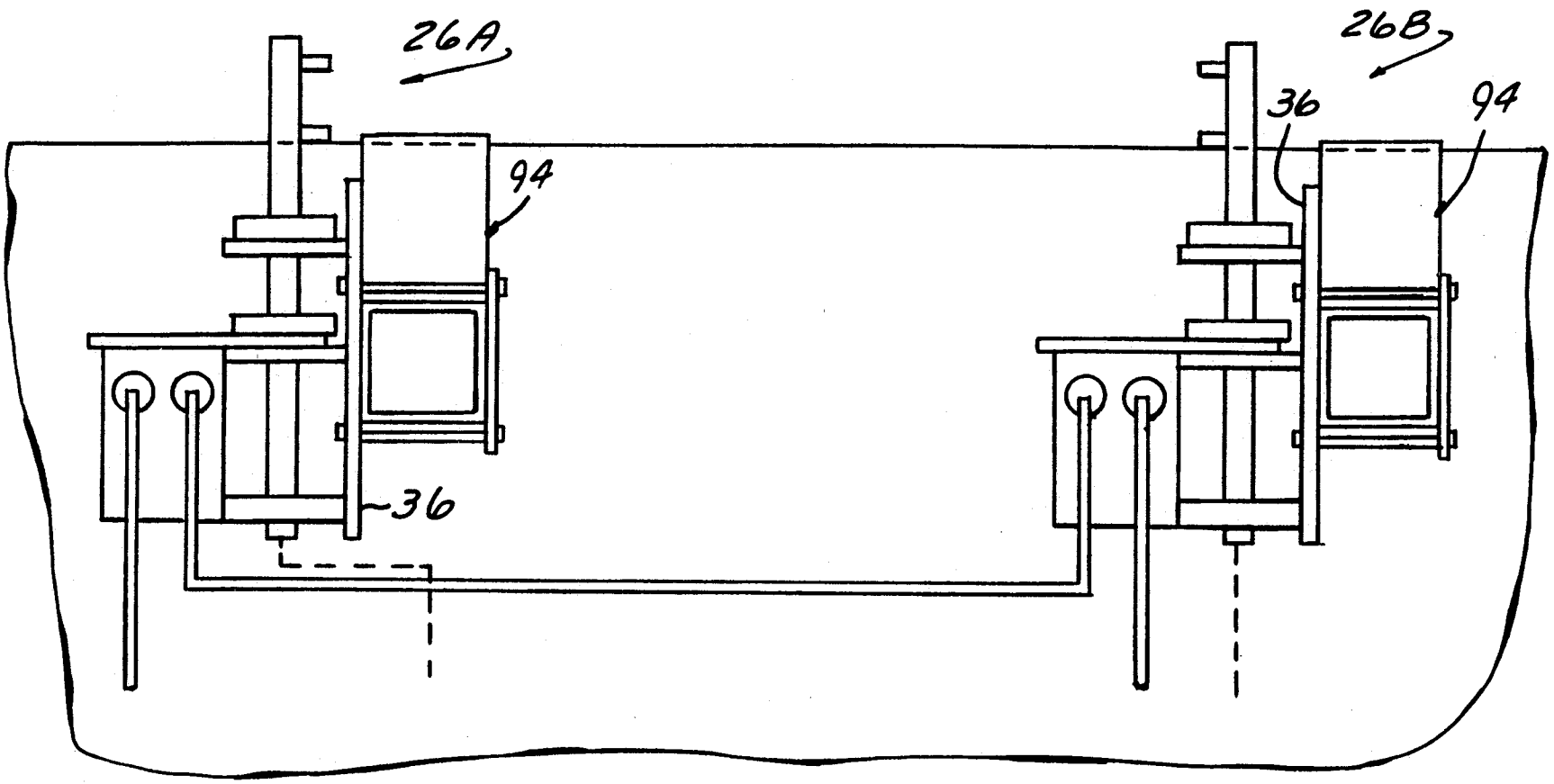
FIG. 4 is a side elevational view of base modules used as the front and rear spray units installed in the system shown in FIG. 1.
Figure 6:
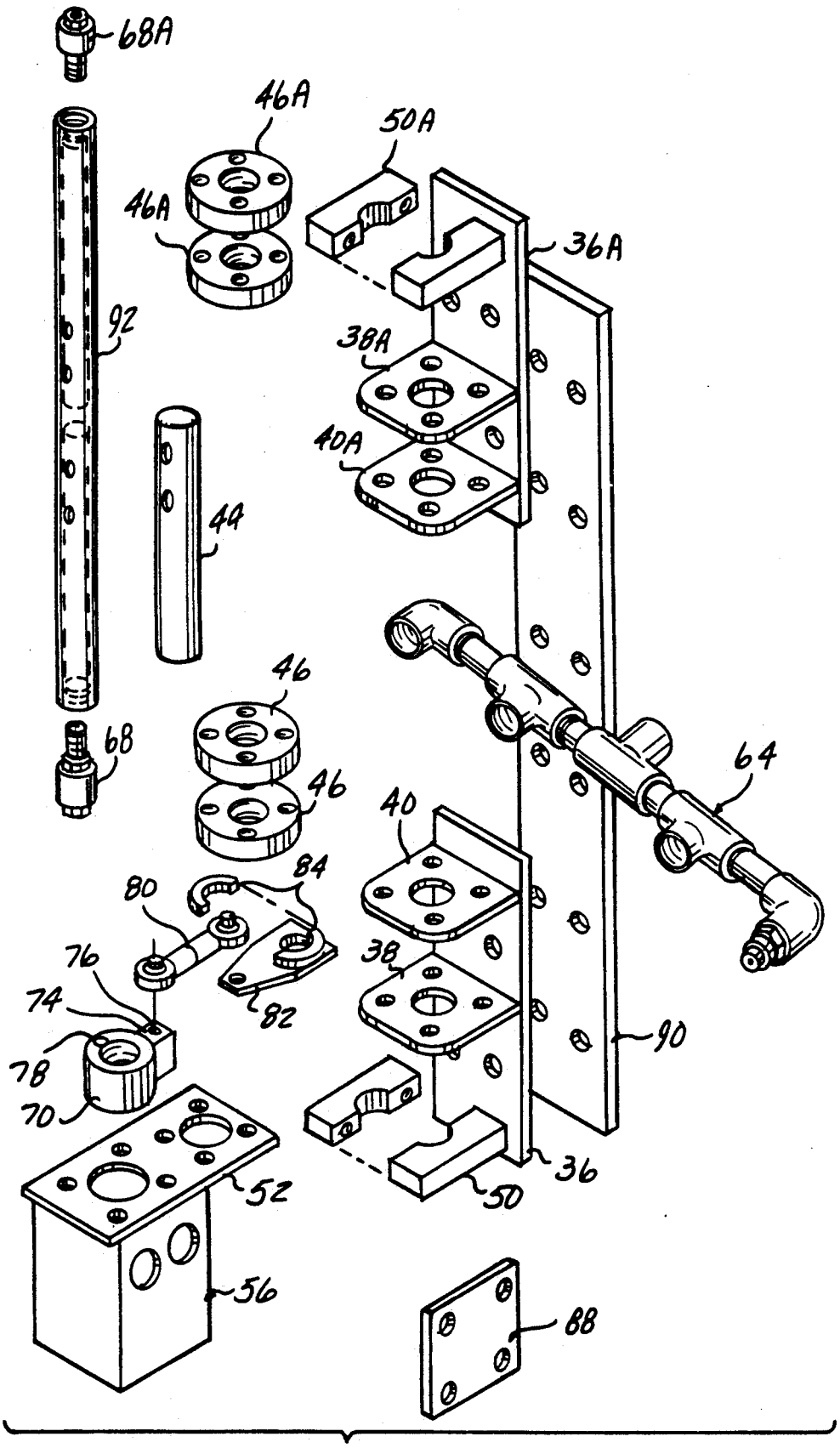
FIG. 6 is an exploded perspective view of the common parts incorporated in the base module according to the present invention and auxiliary configurations able to be used in vehicle washing spray systems.

The base unit 34 is employed as the front and rear spray units 36A, 26B, in a vertical orientation as shown in FIGS. 3 and 4, with the bracket base plates 36 each clamped to a square section 94 of a mounting bracket 96 installed on the edge of the trough of the system.

Accordingly, by means of a few simple parts assembled into bracket modules and motor modules, an entire system can be assembled. The design allows adding units or auxiliary nozzles at any time, or to add these units to spray wash systems of other designs.

Additional spray units may be employed, such as a second side unit on either side arch section 12A, 12B at a higher level. In this case a linkage connection can be employed to oscillate the higher level unit by the motor of the lower unit.

I claim:

1. A vehicle washing spray system for directing a spray pattern of washing solution at a vehicle moved along a path, said system comprising:

an arch structure defining a pair of side sections and an overhead section extending between the side sections and connected to an upper end of each side section;

a trough extending along said path below the level along which said vehicle moves;

a plurality of spray units arrayed about said path, mounted on said arch structure and in said trough, including at least one spray unit on each side section, at least one spray unit on said overhead section, and at least one spray unit in said trough to be positioned below the vehicle moved along said path;

each of said spray units incorporating a substantially identical base spray unit comprised of a bracket module separate from said arch structure and adapted to be mounted thereto, including a spray nozzle manifold shaft having a longitudinal axis and an internal passage, a series of nozzles mounted on said spray nozzle manifold shaft to receive pressurized liquid flow via said passage, a base plate, and bracket means on said base plate rotatably supporting said spray nozzle manifold shaft for rotation about said longitudinal axis, each of said spray units also including a motor module including an oscillation motor mounted above said manifold shaft on said base plate having an output shaft extending parallel to said longitudinal axis of said manifold shaft, and linkage means interconnecting said motor output shaft and said spray nozzle manifold shaft to cause oscillation of said spray nozzle manifold shaft in said bracket means of said base plate of said bracket module;

means mounting said base plate of said bracket module of each of said base spray units to a respective one of said arch side sections, overhead section, and in said trough;

at least one of said spray units configured in a double spray nozzle configuration, said configuration provided by incorporation of a second bracket module identical to said first mentioned bracket module, said second bracket module including a base plate and bracket means thereon, a connector base plate connecting said first mentioned bracket module base plate and said second bracket module base plate end to end, and wherein said spray nozzle manifold shaft comprises a double length spray nozzle manifold shaft rotatably mounted by said first mentioned and second bracket module base plate, and two sets of spray nozzles mounted on said double length spray nozzle manifold shaft.

2. The vehicle washing spray system according to claim 1 wherein said base spray unit mounted in said trough has said base plate of said bracket module thereof arranged so that said spray nozzle manifold shaft extends vertically, and wherein said base spray units mounted to said arch side sections and said arch overhead section have said base plate of said bracket modules thereof arranged so that said spray nozzle manifold shaft included in each of said bracket modules extends horizontally.

3. The vehicle washing spray system according to claim 1 wherein each of said bracket modules includes a clamping bracket at one end of said spray nozzle manifold shaft and further includes a rotary fluid coupling for connection to a supply, installed on said one end of said spray nozzle manifold shaft and clamped in said clamping bracket.

4. A spray unit for use in a vehicle washing system comprising:

a bracket module including a base plate having spaced apart brackets affixed thereto;

a spray nozzle manifold shaft having a longitudinal axis and mounted in said brackets for rotation about said longitudinal axis, said shaft being formed with an internal passage extending lengthwise within said shaft and adapted to receive liquid flow therein;

a spray nozzle set mounted to said spay nozzle manifold shaft in communication with said passage to receive the liquid flow therefrom;

a motor module connected to said bracket module and including an oscillation motor mounted above said base plate and having an output shaft extending parallel to said longitudinal axis of said spray nozzle manifold shaft, and also including crank-linkage means drivingly connecting said motor output shaft and said spray nozzle module shaft to cause oscillation of said spray nozzle and aligned therewith module shaft by rotation by said motor;

a second bracket module substantially identical to said first bracket module and means connecting said second bracket module aligned with said first mentioned bracket module, said second bracket module including a base plate and spaced apart brackets aligned with the brackets in said first mentioned bracket module, and wherein said spray nozzle manifold shaft comprises an elongated spray nozzle manifold shaft rotatably mounted in both of said bracket modules, said shaft having an internal passage extending inwardly from both ends of said shaft, and a second spray nozzle set mounted to said spray nozzle manifold shaft in communication with said internal passage to receive the liquid flow therefrom;

each of said first mentioned and second bracket modules including a clamping bracket, each located at an opposite end of a respective bracket plate, a rotary fluid coupling secured in each clamping bracket, each rotary fluid coupling mounted in a respective end of said spray manifold shaft, said internal passage blocked intermediate said ends to establish independent fluid supply to each of said spray nozzle sets.

5. The vehicle washing spray system according to claim 4 wherein said means for connecting said base plates comprises a connector plate extending beneath each of said base plates and fastened thereto.

6. A method of fabricating a spray nozzle system in a car wash apparatus in which vehicles are conveyed along a path, through an arch structure including two side sections and a connecting overhead section, including the steps of:

constructing a series of identical base spray units, each base spray unit forming a separate assembly from said arch structure and including a spray nozzle set and drive means for oscillating said spray nozzle set;

constructing substantially identical bracket modules incorporated in each base spray unit, constructing each bracket module to include a spray nozzle manifold shaft, a base plate separate from said arch structure, and a series of brackets affixed to said base plate, said brackets rotatably mounting said spray nozzle manifold shaft, said manifold shaft formed with an internal passage and said spray nozzle set mounted thereto to receive liquid flow therefrom;

mounting said base spray units on said arch structure, alongside and extending over the path of said vehicles passing through said apparatus by attaching said base plate of each bracket module to said arch sections to install said spray units on each of said side and overhead sections of said arch.

7. The method as set forth in claim 6 further including the step of constructing at least one substantially identical additional bracket module including a base plate and connecting said base plate of said additional bracket module end-to-end to said base plate of said first mentioned bracket module of at least one of said plurality of base spray units, and installing a single spray nozzle module shaft extending through both of said connected bracket modules.

* * * * *